US008571741B2

(12) United States Patent
El Fassi et al.

(10) Patent No.: US 8,571,741 B2
(45) Date of Patent: Oct. 29, 2013

(54) DEVICE FOR MEASURING THE MOVEMENT OF A SELF-GUIDED VEHICLE

(75) Inventors: Said El Fassi, Vigneux sur Seine (FR); Alain Maire, Montigny le Bretonneux (FR)

(73) Assignee: Siemens SAS, St. Denis (FR)

( * ) Notice: Subject to any disclaimer, the term of this patent is extended or adjusted under 35 U.S.C. 154(b) by 646 days.

(21) Appl. No.: 12/747,371

(22) PCT Filed: Dec. 10, 2007

(86) PCT No.: PCT/FR2007/002031

§ 371 (c)(1),
(2), (4) Date: Sep. 8, 2010

(87) PCT Pub. No.: WO2009/074725

PCT Pub. Date: Jun. 18, 2009

(65) Prior Publication Data

US 2011/0029180 A1 Feb. 3, 2011

(51) Int. Cl.
*G06F 19/00* (2011.01)

(52) U.S. Cl.
USPC ..... 701/23; 701/455; 701/500; 701/504; 701/505; 348/118; 348/148

(58) Field of Classification Search
USPC ..... 701/23, 455, 500, 504, 505; 348/118, 348/148
See application file for complete search history.

(56) References Cited

U.S. PATENT DOCUMENTS

| | | | | |
|---|---|---|---|---|
| 4,075,538 | A * | 2/1978 | Plunkett | 318/52 |
| 5,385,393 | A * | 1/1995 | Tanaka et al. | 303/150 |
| 6,532,419 | B1 * | 3/2003 | Begin et al. | 701/504 |
| 6,641,090 | B2 * | 11/2003 | Meyer | 246/122 R |
| 7,529,609 | B2 * | 5/2009 | Braunberger et al. | 701/70 |
| 8,139,109 | B2 * | 3/2012 | Schmiedel et al. | 348/118 |
| 8,296,065 | B2 * | 10/2012 | Haynie et al. | 701/505 |
| 2002/0088904 | A1 * | 7/2002 | Meyer | 246/124 |
| 2003/0135327 | A1 * | 7/2003 | Levine et al. | 701/220 |
| 2005/0137761 | A1 * | 6/2005 | Lungu | 701/20 |
| 2009/0216418 | A1 * | 8/2009 | Braunberger et al. | 701/70 |
| 2009/0259424 | A1 * | 10/2009 | Dutta et al. | 702/85 |
| 2010/0017124 | A1 * | 1/2010 | Zhao et al. | 701/212 |
| 2011/0029180 | A1 * | 2/2011 | El Fassi et al. | 701/23 |
| 2012/0035823 | A1 * | 2/2012 | Carter et al. | 701/70 |

FOREIGN PATENT DOCUMENTS

| | | | |
|---|---|---|---|
| DE | 10 2005 001 403 | A1 | 7/2006 |
| EP | 0 716 001 | A1 | 6/1996 |
| EP | 0 736 441 | A1 | 10/1996 |

OTHER PUBLICATIONS

International Search Report of PCT/FR2007/002031, Dated October 8, 2008.

* cited by examiner

*Primary Examiner* — Thomas Black
*Assistant Examiner* — Wae Louie
(74) *Attorney, Agent, or Firm* — Lauren A. Greenberg; Werner H. Stemer; Ralph E. Locher

(57) ABSTRACT

A device for measuring the movement of a self-guiding vehicle, that has an enhanced measuring reliability, in particular during an adhesion loss and independently from the travel profile of the vehicle in terms of slope, turn and slant. To this end, the device for measuring the movement of a self-guiding vehicle includes on board thereof two accelerometers coupled to a movement calculator, wherein each accelerometer includes two measurement axes on which are measured projections of a vehicle acceleration resultant. The four measurement axes of the accelerometers are adjusted so that the calculator provides, from the four projection measures, at least one very accurate longitudinal acceleration value of the vehicle at each point of a route including both slopes and turns.

15 Claims, 2 Drawing Sheets

DEVICE FOR MEASURING THE MOVEMENT OF A SELF-GUIDED VEHICLE

BACKGROUND OF THE INVENTION

Field of the Invention

The present invention relates to a device for measuring the movement of a self-guided vehicle which comprises, onboard the vehicle, an accelerometer having two measurement axes in a longitudinal plane defined by a first longitudinal axis according to a principal movement of the vehicle, assumed to be rectilinear, and of a second axis perpendicular to the floor of the vehicle, and a computer connected to receive an output signal associated with each measurement axis. Each output signal comprises a protection measurement of a total acceleration resultant of the vehicle on the associated measurement axis.

Numerous methods or devices for measuring movement, speed or acceleration of a vehicle are known nowadays, in particular for vehicles intended for public transport such as a carriage of a train, of a metro train, a trolleybus, a tramway car, a bus or any other vehicle driven in traction by at least one trackway or a rail such as a guide rail. In particular, in the case of a vehicle which is self-guided by a traffic system (railway signals, onboard and/or remote autopilot system of the vehicle, etc.), measures to provide self-guidance which is reliable (against breakdown) and safe (for the passengers or goods) are indispensable whatever the nature of the route of the vehicle. In this sense, it is essential to be accurately informed in real time about the position, the speed (and the acceleration) of the vehicle, in particular in situations where the vehicle incurs unavoidable loss of adhesion, such as during slipping (during acceleration of the vehicle) or wheel locking (during braking of the vehicle) of the free-running measurement axle or drive axle.

When the guided vehicle has an axle which is free of any tractive or braking force, the movement of the vehicle is directly provided by the rotation of the axle (or one of the wheels associated with this axle).

However, this solution reduces the tractive or braking power and thus the performance of the vehicle, and this is why the majority of systems do not have free-running axles.

In the absence of a free-running axle and to overcome the consequences associated with slipping/wheel locking, with loss of adhesion of one of its wheels, several devices exist and use:

- either measuring means which are completely independent of the wheels permitting a measurement of speed by optical means or even by means of a Doppler effect radar system. These costly devices generally use, however, an additional tachometer for operation at low speed and when the vehicle is stationary, said tachometer making it possible to obtain the angular speed of a wheel or the number of revolutions of the wheel per unit of time;
- or inertial units combining accelerometers, gryometers and terrestrial localization systems such as a GPS. Said systems, however, remain very costly due to their high-level technology, frequently used in applications for aeronautical systems;
- or, such as in EP 0 716 001 B1, a single tachometer arranged on an axle and a means for taking into account a safety margin for the values measured on one wheel or on the wheels in order to attempt to compensate for the effects of possible slipping/wheel locking which impairs the performance for measuring movement as it still remains too approximate. This also results in an anti-lock system as compensation which may be very abrupt for a vehicle and its passengers or goods;
- or, such as in US 2005/0137761 A1, an accelerometer fitted in the vehicle and a tachometer on an axle, the measurement signals of which are linked to an appropriate central computer, even if not specifically disclosed, to take into account errors which occur in the event of loss of adhesion and to provide the speed and the position of the vehicle on its route. In particular, the accelerometer comprises two measurement axes in order respectively to determine an acceleration in one direction of the trajectory of the vehicle and in order to determine and thus take into account, in the calculation of movement, a slope of the vehicle relative to a horizontal plane. Values of the measurement signals of the accelerometer and of the tachometer are also compared to threshold speed values which, if they exceed a threshold, make it possible to indicate the presence of loss of adhesion (slipping/wheel locking) of the vehicle. Although the effects of slope sustained by the vehicle are taken into account, other effects associated with the trajectory of the vehicle are inevitable depending on the position of the accelerometer (and of the positioning of the two measurement axes thereof) in the vehicle, as a railway transport unit frequently has an elongate geometry along which a single accelerometer and a tachometer placed upstream of the vehicle may not provide a measurement means which shows the effects acting on the complete assembly of the vehicle such as, for example, the effects of turn or lateral acceleration.

All these devices make it possible, therefore, to calculate the movement of a guided vehicle, which does not have axles which are free of any braking and tractive force, and which runs on a track of any profile but with an accuracy which is much lower than that of an "ideal" system with a free-running axle, as they may not completely overcome losses of adhesion (slipping and wheel locking caused by tractive/braking forces) in addition to errors caused by lateral acceleration (turn, slant) and even vertical acceleration (slope).

BRIEF SUMMARY OF THE INVENTION

One object of the present invention is to propose a device for measuring the movement of a self-guided vehicle that has enhanced measuring reliability, in particular during an adhesion loss and independently from the travel profile of the vehicle in terms of slope, turn and slant.

To this end, a device for measuring the movement of a self-guided vehicle comprising two on-board accelerometers, each including two measurement axes and of which the measurement signals are coupled to a computer for calculating the movement, is proposed as claimed in claim 1.

As one possibility, at least one tachometer may be mounted on one of the axles of the vehicle and also coupled to the computer for processing data thus provided from all the sensors (accelerometers and tachometer). The measurement signals delivered by the tachometer may be utilized to improve the accuracy of the device.

The device according to the invention, based on accelerations measured on the measurement axes, provides data regarding the speed and longitudinal movement of the vehicle (for example along a railway track). It may be associated with any type of on-board device likely to require an accurate and continuous measurement of the speed and of the movement of the vehicle, irrespective of the conditions of rail/wheel adhesion and whatever the profile of the route in terms of slope, turn and slant.

The accelerometers and their measurement axes are arranged such that, based on measurements taken on the different measurement axes, they permit longitudinal acceleration, lateral acceleration and slope acceleration of the vehicle to be calculated in order to determine subsequently the speed and the longitudinal movement of the vehicle by the integration of time onto the acceleration values.

The device according to the invention also advantageously makes it possible to detect in a reliable manner an immobilization of the vehicle on its route and produces to this end information about zero speed from information delivered by the sensors.

The device comprises a means for auto-calibration and auto-testing which makes it possible, when the vehicle is immobile, to verify the correct functioning of the sensors and as a result to guarantee with a high degree of reliability data made available by other on-board systems.

One appropriate use of the device according to the invention covers the field of guided vehicles whatever their type of guidance (mechanical or intangible, i.e. without a mechanical connection between the ground and the vehicle) in particular trains, metro trains, tramway cars or buses and whatever the type of operation (axles, bogies) with iron wheels or tires. It is noteworthy here that for this category of vehicle with an elongate geometry/chassis, the effects of turn and slope are not negligible, depending on the position (or the offset) of the accelerometers on-board the vehicle. The invention thus advantageously permits these effects to be overcome in order to determine the movement of the vehicle more accurately.

The device according to the invention thus makes it possible to calculate the movement of a guided vehicle which does not have axles free of any braking and tractive force, and which runs on a track of any type of profile, maintaining an accuracy which is equivalent to that of a system with free-running axles, whilst overcoming loss of adhesion (slipping and wheel locking caused by tractive/braking forces) and errors caused by lateral acceleration (turn) and vertical acceleration (slope).

A set of sub-claims also presents advantages of the invention.

BRIEF DESCRIPTION OF THE SEVERAL VIEWS OF THE DRAWING

Exemplary embodiments and examples of application are provided with reference to the figures described, in which.

DESCRIPTION OF THE INVENTION

Figure 1:
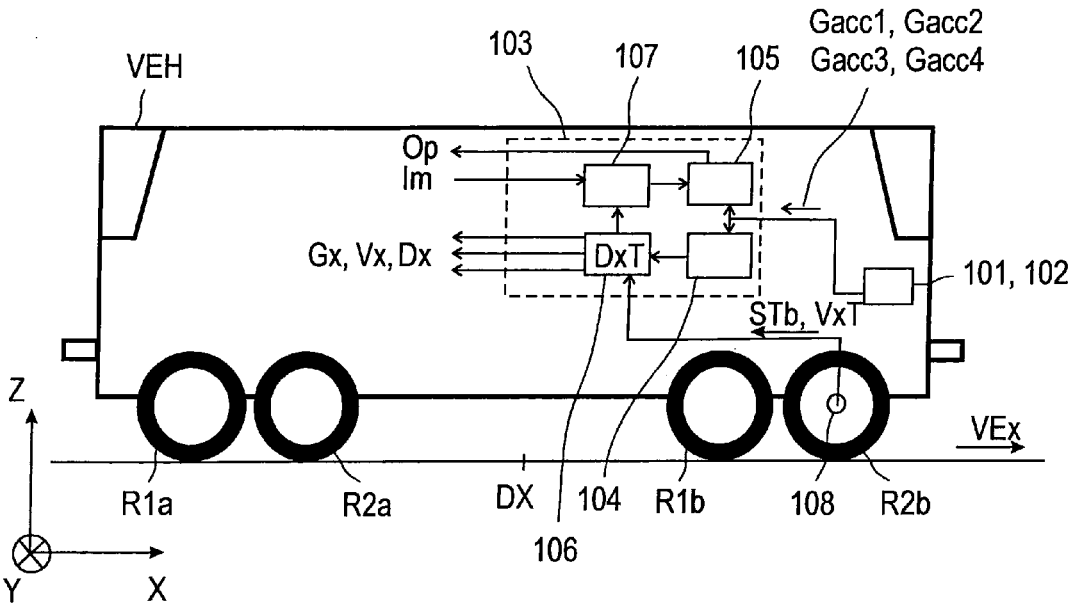
FIG. 1 shows a vehicle provided with a device for measuring movement of the self-guided vehicle according to the invention.
Figure 2:
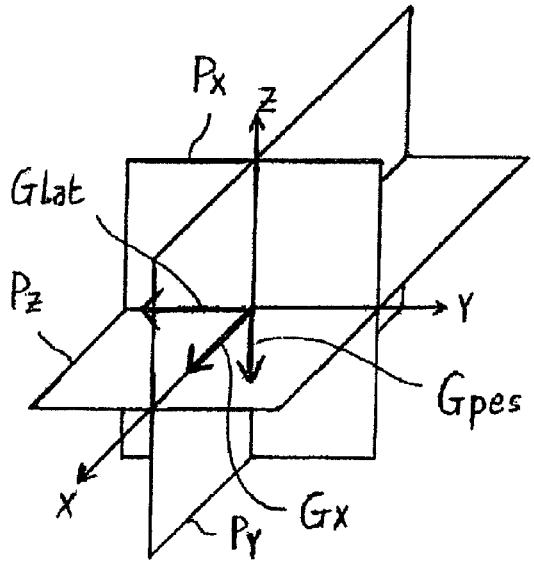
FIG. 2 shows a diagram for defining the planes associated with the vehicle in motion.
Figure 3:
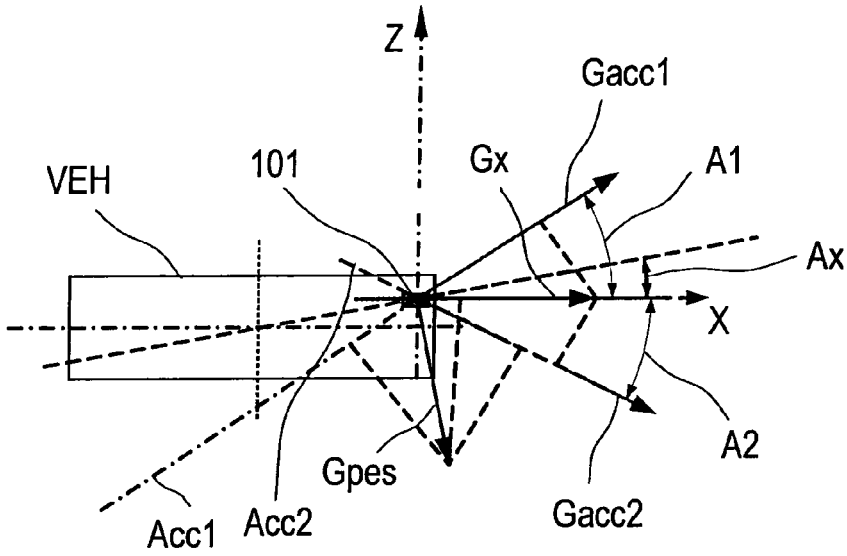
FIG. 3 shows a diagram for taking into account the effect of slope on the device.
Figure 4:
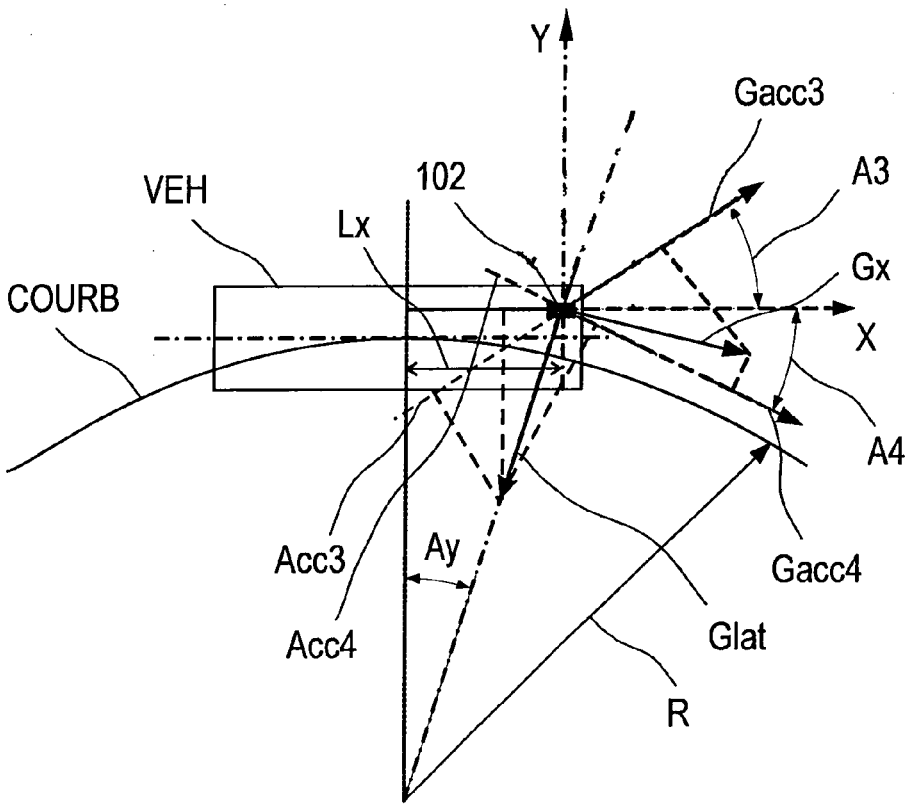
FIG. 4 shows a diagram for taking into account the effect of turn on the device.

FIG. 1 shows a vehicle VEH provided with a device for measuring the movement of the self-guided vehicle according to the invention and, possibly associated with FIG. 2, clarifying how the planes associated with the vehicle in motion are defined according to the acceleration sustained by the vehicle and measured by two accelerometers 101, 102. FIGS. 3 and 4 show the arrangement of measurement axes Acc1, Acc2, Acc3, Acc4 of the accelerometers according to the planes selected according to the type of acceleration Gx, Glat, Gpes (longitudinal movement, effect of turn or/and of slope) sustained by the vehicle as a co-ordinate (X, Y, Z) centered on the accelerometers and of which the axis X indicates the direction of the longitudinal trajectory of the vehicle.

The device for measuring movement (real-time position Dx) of the self-guided vehicle VEH comprises on-board thereof:

- an accelerometer 101 provided with two measurement axes Acc1, Acc2, in a longitudinal plane Py defined by a first longitudinal axis X according to a principal movement VEx, assumed to be rectilinear, of the vehicle and a second axis Z perpendicular to the floor of the vehicle,
- a computer 103 connected to an output signal S1, S2 associated with each measurement axis Acc1, Acc2 where each output signal S1, S2 includes a measurement as an orthogonal projection Gacc1, Gacc2 of a total acceleration resultant of the vehicle on the associated measurement axis Acc1, Acc2,
- a second accelerometer 102 being provided with at least two measurement axes Acc3, Acc4 in a horizontal plane Pz defined by the first axis X and a third axis Y perpendicular to the first and to the second axis X, Z,
- the computer 103 is connected to an output signal S3, S4 associated with each measurement axis Acc3, Acc4, where each output signal S3, S4 includes a projection measurement Gacc3, Gacc4 of the total acceleration resultant of the vehicle on the associated measurement axis Acc3, Acc4,
- all the measurement axes Acc1, Acc2; Acc3, Acc4 of the first and of the second accelerometer 101, 102 have in their respective plane Py, Pz an adjustable relative angle A1+A2, A3+A4 which is thus adjusted so that the computer 103 provides from the four projection measurements Gacc1, Gacc2, Gacc3, Gacc4, at least one instantaneous value of longitudinal acceleration Gx of the vehicle at each point of a route including both slopes and turns. In other words, the value of longitudinal acceleration Gx is an exact acceleration value, taking into account the effects of slope and turn. Similarly, a loss of adhesion leading to the falsification of an acceleration measurement which would be deduced from the rotation of the axles, may be ideally compensated here.

Chiefly, therefore, the device according to the invention uses two bi-axial accelerometers 101, 102 fixed to the body of the vehicle and intended to measure a longitudinal acceleration and a lateral acceleration of the vehicle. The vehicle is subjected to three forces producing a longitudinal acceleration Gx (movement of the vehicle subjected to tractive/braking forces), a lateral acceleration Glat (the turn of the trajectory causing centrifugal acceleration) and a vertical acceleration Gpes due to the gravity which is exerted in the presence of a slope (the slope of the trajectory). The first accelerometer 101 of which the two axes Acc1, Acc2 are located in the vertical plane Py and the second accelerometer 102 of which the two axes Acc3, Acc4 are located in the horizontal plane Pz, make it possible to measure a resultant of the accelerations (longitudinal, lateral, gravity) projected on each of the four measurement axes. The angles between the different measurement axes of the accelerometers are known and fixed after adjustment. The computer 103 solves a system composed of four equations in order to determine four unknowns at the position Dx of the vehicle, namely a slope angle Ax of the trajectory, a lateral acceleration angle Ay (resultant of the centripetal force due to the speed of the vehicle and dependent on the radius of curvature R of the trajectory in addition to the offset of the accelerometer relative to the center of the vehicle), a value of lateral acceleration Glat and the value of longitudinal acceleration Gx. By successive integration over the duration of the journey, the computer 103 determines the longitudinal speed Vx and the longitudinal movement Dx of the vehicle VEH over its route for any slope and turn COURB.

If required, the device according to the invention is complemented by a tachometer 108 to improve the accuracy of the above measurement of the speed Vx and of the distance Dx covered. The tachometer 108 is fixed to one of the axles R1*a*, R2*a*, R1*b*, R2*b* of the vehicle VEH and its output signal(s) STb (is) are transmitted to the computer 103. The computer 103 evaluates a movement DxT and a speed VxT based on measurement signal(s) of the tachometer. The computer carries out a comparison between the results of the measurement of movement from the tachometer and those from the accelerometers. When for these measured values, a difference in measurement is lower than a threshold, the measurement values are reset to those of the tachometer. In the opposite case (value greater than a threshold) there is no correction of the results from the measurement of the accelerometers.

As shown in FIG. 1, zero speed information Op may also be reliably provided by the computer 103 from information Im originating from equipment of the vehicle (immobilization signal, zero speed indicator, etc.) or be determined by the device according to the invention itself. To determine this information, the computer 103 processes the information from the tachometer and the accelerometers.

When the device determines zero speed and due to the specifics of the proposed mounting of the accelerometers, the device also advantageously has the capacity to implement an auto-test function. This auto-test function makes it possible to evaluate the corrections which have to be made to the measurements from the accelerometers (after auto-calibration) and to identify faults in the operation of the accelerometers. The multiplicity of the measurement axes provides a redundancy which is very advantageous for several measurements (due to the two bi-axial accelerometers) and makes it possible by a periodic verification of reliability of the accelerometers (for example at each stop at a station) to guarantee test measurements (and thus subsequent movement) with a very low probability of error, making them compatible with the safety demands of a reliable system as required in the railway field.

In the remainder of this description, reference is made to the two FIGS. 3 and 4.

Considering the measurement axes Acc1, Acc2 of the first accelerometer 101 (see FIG. 3 where, for reasons of clarity, the lateral acceleration Glat has deliberately been omitted), the components of the projection measurements Gacc1, Gacc2, by adding the projections of the accelerations Gx, Glat, Gpes on each of the axes Acc1, Acc2 of the accelerometer 101 are:

on the axis Acc1

$$Gacc1=\text{projection}(Gx)-\text{projection}(Gpes)-\text{projection}(Glat)$$

$$Gacc1=Gx\cos(Ay)\cos(A1)+Gpes\sin(A1-Ax)-Glat\sin(Ay)\cos(A1) \quad (1)$$

on the axis Acc2

$$Gacc2=\text{projection}(Gx)-\text{projection}(Gpes)-\text{projection}(Glat)$$

$$Gacc2=Gx\cos(Ay)\cos(A2)-Gpes\sin(A2+Ax)-Glat\sin(Ay)\cos(A2) \quad (2)$$

Similarly, considering the measurement axes Acc3, Acc4 of the second accelerometer 102 (see FIG. 4 where, for reasons of clarity, the slope acceleration Gpes has deliberately been omitted), the components of projection measurements Gacc3, Gacc4 by the addition of the projections of the accelerations Gx, Glat, Gpes on each of the axes Acc3, Acc4 of the accelerometer 102 are:

on the axis Acc3

$$Gacc3=\text{projection}(Gx)-\text{projection}(Glat)-\text{projection}(Gpes)$$

$$Gacc3=Gx\cos(A3+Ay)-Glat\sin(A3+Ay)-Gpes\sin(Ax)\cos(A3) \quad (3)$$

on the axis Acc4

$$Gacc4=\text{projection}(Gx)-\text{projection}(Glat)-\text{projection}(Gpes)$$

$$Gacc4=Gx\cos(A4-Ay)+Glat\sin(A4-Ay)-Gpes\sin(Ax)\cos(A4) \quad (4)$$

With for the equations (1) to (4):

- the angle A1 in the plane Py between the axis X and the axis Acc1
- the angle A2 in the plane Py between the axis X and the axis Acc2
- the angle A3 in the plane Pz between the axis X and the axis Acc3
- the angle A4 in the plane Pz between the axis X and the axis Acc4
- the angle Ax of the trajectory of the vehicle in the plane Py (i.e. the angle between the horizontal and the axis X)
- the offset distance Dx between the center of the vehicle and the fixing point of the accelerometers 101, 102 installed on the vehicle
- the angle Ay associated with the radius of curvature R in the plane Py. The angle Ay is calculated by Arctg (Lx/R), thus in a first approximation Lx/R, given that the value of the radius of curvature R is usually greater than the offset distance Lx.

The resolution of the system formed by the four equations (1) to (4) falls within the scope of mathematical techniques which are not disclosed here and of which the object is to calculate the four variables Gx, Glat, Ax and Ay according to the measurements of acceleration values Gacc1, Gacc2, Gacc3, Gacc4 of which the computer 103 makes use.

However, the resolution of the system is advantageously simplified in certain specific hypotheses for the arrangement of the accelerometers 101, 102.

From these hypotheses may be selected the relative angles A1+A2, A3+A4 each defining a right angle, i.e.: A1+A2=90° and A3+A4=90°. Thus, the device according to the invention may provide that at least one of the relative angles A1+A2, A3+A4 is a right angle.

The device according to the invention is implemented such that each relative angle A1+A2, A3+A4 is in fact subdivided (or subdivisible) into a first and a second angle A1, A2 and respectively A3, A4 corresponding to projection angles between the four measurement axes Acc1, Acc2, Acc3, Acc4 of the first and of the second accelerometer 101, 102 and the first axis X (longitudinal axis according to a principal movement of the vehicle, assumed to be rectilinear).

In this regard, it is also very advantageous to select the angles A1, A2, A3, A4 so that A1=A2 and A3=A4, and in particular so that A1=A2=A3=A4=45°.

Regarding the choice of angles A1, A3, it is also possible to attribute to them adjustable values making it possible to estimate in the best possible manner the effects of slope or turn without impairing the accuracy of the measurement of longitudinal acceleration.

By way of example, if the option is selected in which the projection angles A1, A2; A3, A4 of each accelerometer are equal, i.e. A1=A2 and A3=A4, the above system of equations becomes:

$$Gacc1=Gx\cos(Ay)\cos(A1)+Gpes\sin(A1-Ax)=Glat\sin(Ay)\cos(A1) \quad (1)$$

$$Gacc2=Gx\cos(Ay)\cos(A1)-Gpes\sin(A1+Ax)-Glat\sin(Ay)\cos(A1) \quad (2)$$

$$Gacc3=Gx\cos(A3+Ay)-Glat\sin(A3+Ay)-Gpes\sin(Ax)\cos(A3) \quad (3)$$

$$Gacc4=Gx\cos(A3-Ay)+Glat\sin(A3-Ay)-Gpes\sin(Ax)\cos(A3) \quad (4)$$

The resolution of this system makes it possible to determine easily the four unknowns which are sought and defined by the variables Gx, Glat, Ax, Ay, then by integration over a duration of movement to deduce therefrom the longitudinal speed Vx and the associated position Dx over the route of the vehicle:

$$Vx=\int(Gxdt)$$

$$DX=\int(Vxdt)$$

The device according to the invention thus permits the computer 103 to provide a value of the slope angle Ax, of a lateral acceleration angle Ay (i.e. representing the rotation of the lateral acceleration at the fixing point of the mounting of the accelerometer relative to which it would be at the center of the vehicle for the radius of curvature R) at each point of the route which includes both slopes and turns.

By extension, the computer 103 provides a speed Vx and a position Dx at each point of the route which includes both slopes and turns by integrating successively the value of longitudinal acceleration Gx of the vehicle.

As disclosed above, the device may also comprise:

- a tachometer 104 arranged on at least one axle of the vehicle and providing a tachymetric value of speed VxT and position DxT of the vehicle,
- the tachymetric values VxT, DxT and the speed and position values Vx, Dx obtained and respectively delivered by the computer 103 are provided to a comparator 106 incorporated in the computer 103,
- the comparator 106 determines the differences between the categories of speed and position values, and if said differences are below a predefined threshold, a resetting of the speed and position values Vx, Dx provided by the computer 103 at each point of the route which includes both slopes and turns is implemented on the tachymetric values VxT, DxT. If the difference is above the threshold, the resetting is inhibited.

This possibility of resetting provides an increase in the accuracy of measuring the speed and movement based on a simple additional measurement of speed and movement which is proportional to the radius of the wheel.

The device according to the invention may also comprise a means for detecting zero speed 107 of the vehicle which is incorporated in or coupled to the computer 103 and to the tachometer 104. Said tachometer comprises at least one correlator of the speed and position values Vx, Dx delivered by the computer 103 and corresponding tachymetric values VxT, DxT.

As a result, a very reliable function for detecting zero speed is implemented, namely:

- by taking into account information which is external to the device made available by one of the devices of the vehicle (for example by means of an internal signal of the immobilized vehicle, etc.)
- by determining a stoppage of the vehicle by filtering information about speed and movement Vx, Dx provided by the computer 103. This determination may thus be correlated with the corresponding tachymetric data VxT, DxT.
- following this processing, if it is certain that the vehicle is genuinely stopped, the device provides so-called zero speed information.

A function known as auto-test may thus advantageously use the so-called zero speed information. When this information is legitimately provided, it means that the vehicle is immobile and as a result, the longitudinal and lateral acceleration are thus zero.

The associated test thus consists in checking that the measurement values delivered by the accelerometers 101, 102 verify the system of equations (1), (2), (3), (4) provided above, which is thus reduced to:

$$Gacc1=Gpes\sin(A1-Ax) \quad (1)$$

$$Gacc2=-Gpes\sin(A2+Ax) \quad (2)$$

$$Gacc3=-Gpes\sin(Ax)\cos(A3) \quad (3)$$

$$Gacc4=-Gpes\sin(Ax)\cos(A4) \quad (4)$$

An example of resolution of this system is provided here in the particular hypothesis of the arrangement of the accelerometers, for which the projection angles A1, A2; A3, A4 are equal for each pair in each of the planes Py, Pz, i.e. that A1=A2 and A3=A4:

From the two last equations (3) and (4) the following relations (5) and (6) may be deduced:

$$Gacc3=Gacc4 \quad (5)$$

$$\mathrm{Sin}(Ax)=-Gacc3/(Gpes\,\mathrm{Cos}(A3)) \quad (6)$$

Relative to the term Sin(Ax) in the equations (1) and (2), it is thus possible to verify the measured values of the projected accelerations Gacc1, Gacc2 of the first accelerometer 101 with the above calculated results.

The projected accelerations Gacc3, Gacc4 of the second accelerometer 102 are verified by the equation (5). In a first approximation, it is reasonable to consider that the slope has little influence on the measurement which is generally the case, for example, when parking in the garage or when stopped at the station.

In order to refine the verification of the projected accelerations Gacc3, Gacc4 of the second accelerometer 102 it is, however, also possible to read a value of the slope from a data bank.

By these verifications and by selecting a filtering threshold, it is possible to determine correction factors to be made to the measurements from the accelerometers. In the case of the second accelerometer 102 it is advantageously possible to benefit from the slow process of the accelerometer drift before modifying its correction factors. These correction factors are applied following a confirmation obtained after several stops. This number of stops is adjustable according to the degree of accuracy maintained. This makes it possible to auto-calibrate the device according to the invention.

A second selected threshold which is higher than the first threshold may also be defined in order to declare that the device according to the invention is not in operation.

In order to implement the auto-test function, the device according to the invention comprises:

a means for auto-calibration 105 of the accelerometers 101, 102 which may be activated if the means for detecting zero speed confirms a stoppage of the vehicle, the means for auto-calibration processing the measurements from the accelerometers 101, 102 and provided by a unit for calculating accelerations 104 (itself receiving the measures from the accelerometers 101, 102 and being included in the computer 103), the means for auto-calibration calibrates the measurements corresponding to the zero values of the longitudinal acceleration Gx and lateral acceleration Glat of the vehicle.

The means for auto-calibration 105 has a first control mode for verifying the equality of the measurement values Gacc3, Gacc4 on the second accelerometer 102 and a means for recalculating the slope angle Ax from which the measurement values Gacc1, Gacc2 of the first accelerometer 101 are verified by means of a second control mode. Thus, the verification becomes very reliable and even more so if the slope angle may be evaluated and confirmed redundantly by known information which is external to the device.

For this embodiment and relative to the auto-test function disclosed above, beyond a first error threshold arising from results of the auto-calibration means 105, correction factors from the auto-calibration means 105 are thus retransmitted to the calculating unit 104 (more usually to the computer 103 for calculating the movement).

Similarly, beyond a second error threshold which is less safe than the first threshold arising from results of the auto-calibration means 105, an indicator of failure of the on-board measurement is activated.

A simplified model of evaluating the probability of failure of the function known as auto-test may thus be implemented considering that, with the stoppage of the vehicle, measurements carried out on the measurement axes acc1, acc2, acc3, acc4 of the accelerometers 101, 102 are obtained redundantly.

Assuming a time interval T between two stops of the vehicle: the probability of failure Pr of the auto-test function applied to the two measurement axes Acc1, Acc21 in the plane Py is defined by:

$$Pr=\lambda acc1*Aacc2*T$$

Where the respective failure rates Aacc1 and Aacc2 of the measurement axes Acc1 and Acc2 of the bi-axial accelerometers are each assumed to be equal to a usually permitted value of $10^{-5}$ in the following calculated example:

$$\text{Where } T=60 \text{ seconds}, Pr=10^{-10}*0.017=1.7*10^{-12}$$

$$\text{Where } T=10 \text{ minutes}, Pr=10^{-10}*0.17=17*10^{-12}$$

It is thus apparent that if the vehicle stops periodically and frequently, the device makes it possible to guarantee a level of confidence in the measured data which is required for the safety demanded in the railway field.

According to this evaluation of the probability of failure of the so-called auto-test function, the device according to the invention may thus comprise a means for evaluating the probability of failure which may be activated between two stops of the vehicle and using a redundancy measurement on the measurement axes of the accelerometers. This means of evaluation may be integrated in the auto-calibration means 105 disclosed above.

Finally, the device according to the invention may also optionally comprise a detector of loss of adhesion of the vehicle (in the case of slipping or wheel locking) coupled to at least one of the first and second bi-axial accelerometers 101, 102 for which the movement measurements may be associated with external values (slope, turn from a data bank or data from a route marker system, etc.). In the case of divergence from this data, a risk of loss of adhesion of the vehicle may be detected and, by extension, complement the information provided by the system for detecting zero speed (locked wheel but vehicle in motion).

The detector of loss of adhesion of the vehicle may also, if required, be coupled to at least one tachometer 108 of the axis of the vehicle in addition to one of the first and second accelerometers 101, 102 so as to compare their data for measuring the angular movement and respectively the longitudinal movement. By this means, the function of detecting zero speed may be thus made even more secure.

Principal Abbreviations

X: longitudinal axis (of movement) of the vehicle
Y: axis perpendicular to the axis X and in the plane of the floor of the vehicle
Z: axis perpendicular to the floor of the vehicle
Px: plane at right angles to the axis X and determined by the axes Y, Z
Py: plane at right angles to the axis Y and determined by the axes X, Z
Pz: plane at right angles to the axis Z and determined by the axes X, Y
Gpes: acceleration of gravity=9.81 m/s2
Gx: longitudinal acceleration of the vehicle along the axis X
Glat: lateral acceleration of the vehicle at the location of the accelerometers in the vehicle
Vx: longitudinal speed along the axis X
Dx: longitudinal position/movement along the axis X
VxT: longitudinal speed provided by the tachometer
DxT: longitudinal movement provided by the tachometer
Acc1: first measurement axis of the accelerometer 101
Acc2: second measurement axis of the accelerometer 101
Acc3: first measurement axis of the accelerometer 102
Acc4: second measurement axis 2 of the accelerometer 102
A1: angle in the plane Py between the axis X and the axis Acc1
A2: angle in the plane Py between the axis X and the axis Acc2
A3: angle in the plane Pz between the axis X and the axis Acc3
A4: angle in the plane Pz between the axis X and the axis Acc4
Ax: angle of trajectory of the vehicle in the plane Py (i.e. the angle between the horizontal and the axis X)
Lx: offset distance between the center of the vehicle and the fixing point of the accelerometers 101, 102
Ay: angle associated with the radius of curvature in the plane Py. Ay is calculated by Arctg (Lx/R), thus in a first approximation Lx/R
Vx: longitudinal speed of the vehicle along the axis X

The invention claimed is:

1. A device for measuring a movement of a self-guided vehicle, comprising, on-board the vehicle:

a first accelerometer having two first measurement axes in a longitudinal plane defined by a first longitudinal axis corresponding to a principal movement of the vehicle, assumed to be rectilinear, and of a second axis perpendicular to a floor of the vehicle;

a second accelerometer having at least two second measurement axes in a horizontal plane defined by the first axis and a third axis perpendicular to the first and to the second axis;

a computer connected to receive first output signals associated with each of the two first measurement axes, wherein each first output signal comprises a projection measurement of a total acceleration resultant of the vehicle on the associated measurement axis, and connected to receive second output signals associated with each second measurement axis, wherein each second output signal includes a projection measurement of a total acceleration resultant of the vehicle on the associated measurement axis;

the first and second measurement axes of said first and second accelerometers having in their respective plane an adjustable relative angle, such that, based on the four projection measurements, said computer provides at least one value of longitudinal acceleration of the vehicle at each point of a route including slopes and turns.

2. The device according to claim 1, wherein at least one of the relative angles is a right angle.

3. The device according to claim 1, wherein each relative angle is subdivided into a first angle and a second angle corresponding to projection angles between the first and second measurement axes of the first and second accelerometer and the first axis.

4. The device according to claim 3, wherein the projection angles of each accelerometer are equal.

5. The device according to claim 1, wherein said computer is configured to provide at each point of the route including slopes and turns a value of a lateral acceleration, a value of the slope angle, a lateral acceleration angle resulting from a centrifugal force due to a speed of the vehicle and depending on a radius of curvature of a trajectory and an offset of the accelerometer relative to the center of the vehicle.

6. The device according to claim 5, which further comprises:

an auto-calibration means of said first and second accelerometers to be activated if said zero speed detection means confirms a stoppage of the vehicle;

said auto-calibration means processing the measurements originating from said accelerometers and provided by a unit for calculating accelerations incorporated in said computer; and said auto-calibration means calibrating the measurements corresponding to the zero values of the longitudinal acceleration and the lateral acceleration of the vehicle.

7. The device according to claim 6, wherein, on reaching a first error threshold arising from results of said auto-calibration means, correction factors from the auto-calibration means are transmitted to the computer.

8. The device according to claim 7, wherein, on reaching a second error threshold which is less safe than the first threshold arising from results from the auto-calibration means, an indicator of failure of on-board measurement is activated.

9. The device according to claim 5, wherein said auto-calibration means has a first control mode for verifying a correspondence between the measurement values of said second accelerometer and a means for recalculating the slope angle from which the measurement values of said first accelerometer are verified in a second control mode.

10. The device according to claim 1, wherein said computer is configured to provide a speed and a position at each point of the route including slopes and turns by successively integrating the value of the longitudinal acceleration of the vehicle.

11. The device according to claim 1, which comprises:

a tachometer disposed on at least one axle of the vehicle and providing tachymetric values of speed and position of the vehicle;

a comparator connected to receive the tachymetric values and the speed and position values provided by said computer;

wherein said comparator determines differences between the categories of speed and position values, and, if the values lie below a predefined threshold, a resetting of the speed and position values provided by said computer at each point of the route including slopes and turns is implemented on the tachymetric values.

12. The device according to claim 11, which comprises means coupled to said computer and to said tachometer for detecting a zero speed of the vehicle, said means comprising at least one correlator of the speed and position values provided by said computer and the tachymetric values.

13. The device according to claim 11, which further comprises means for evaluating a probability of failure that may be activated between two stops of the vehicle and using a redundancy measurement on the measurement axes of the accelerometers.

14. The device according to claim 1, which further comprises a detector of loss of adhesion of the vehicle connected to at least one of said first and second accelerometers.

15. The device according to claim 14, which comprises at least one tachometer disposed at an axle of the vehicle and connected to receive a signal from said detector of loss of adhesion of the vehicle.

* * * * *